US009942672B2

(12) United States Patent
Hillbratt et al.

(10) Patent No.: US 9,942,672 B2
(45) **Date of Patent: *Apr. 10, 2018**

(54) DEVICES FOR ENHANCING TRANSMISSIONS OF STIMULI IN AUDITORY PROSTHESES

(71) Applicant: COCHLEAR LIMITED, Macquarie University (AU)

(72) Inventors: Martin Evert Gustaf Hillbratt, Macquarie University (AU); Henrik Fyrlund, Macquarie University (AU); Marcus Andersson, Macquarie University (AU)

(73) Assignee: COCHLEAR LIMITED, Macquarie University (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/380,406

(22) Filed: Dec. 15, 2016

(65) Prior Publication Data

US 2017/0180892 A1 Jun. 22, 2017

Related U.S. Application Data

(63) Continuation of application No. 14/012,852, filed on Aug. 28, 2013, now Pat. No. 9,554,223.

(51) Int. Cl.
*H04R 25/00* (2006.01)

(52) U.S. Cl.
CPC ..... *H04R 25/606* (2013.01); *H04R 25/456* (2013.01); *H04R 25/65* (2013.01); *H04R 2225/63* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,751,334 | B2 | 6/2004 | Hakansson | |
| 7,376,237 | B2 | 5/2008 | Westerkull | |
| 8,005,247 | B2 | 8/2011 | Westerkull | |
| 8,842,870 | B2 * | 9/2014 | East | H04R 1/1066 381/173 |
| 9,554,223 | B2 | 1/2017 | Hillbratt et al. | |
| 2009/0245557 | A1 | 10/2009 | Parker | |
| 2009/0248155 | A1 | 10/2009 | Parker | |
| 2013/0114834 | A1 | 5/2013 | Bern | |

* cited by examiner

*Primary Examiner* — Amir Etesam
(74) *Attorney, Agent, or Firm* — Merchant & Gould P.C.

(57) ABSTRACT

A resilient element is used to bias a vibration element of an auditory prosthesis towards the skin of a recipient. This helps improve transmission of vibration stimuli to the recipient. Additionally, the resilient element helps reduce feedback caused by the vibration element vibrating in close proximity to sound processing components contained within the auditory prosthesis.

19 Claims, 11 Drawing Sheets

DEVICES FOR ENHANCING TRANSMISSIONS OF STIMULI IN AUDITORY PROSTHESES

This application is a continuation of U.S. patent application Ser. No. 14/012,852, filed Aug. 28, 2013, now U.S. Pat. No. 9,554,223, the disclosure of which is hereby incorporated by reference herein in its entirety.

BACKGROUND

An auditory prosthesis can be placed behind the ear to deliver a stimulus in the form of a vibration to the skull of a recipient. These types of auditory prosthesis are generally referred to as transcutaneous conduction devices. The auditory prosthesis receives sound via a microphone located on a behind-the-ear (BTE) device. The sound is processed and converted to electrical signals, which are delivered as a vibration stimulus to the skull of the recipient. The vibration stimulus can be delivered from the BTE device if it is in contact with the skin.

SUMMARY

In embodiments, hearing prosthesis that deliver a vibration stimulus to a recipient can be placed behind the ear with support of an ear hook and an adhesive. The prosthesis can include an integral or discrete vibration element. The vibration element can be designed so as to increase transmission of vibrations from the vibration element to the skull. For example, the vibration element or the BTE device can include an adhesive that helps hold the vibration element to the skin of the recipient. Alternatively, the vibration element can utilize a magnet that interacts with an implanted magnet to hold the element against the skin. Other embodiments can also include springs or other biasing elements that bias the vibration element towards the skin to help ensure proper contact and therefore adequate transmission of the vibrations to the recipient. Additionally, for BTE devices that include an integral vibration element, the spring or biasing element helps reduce transmission of vibration to the portion of the BTE housing that includes the sound processor and microphone. This can help reduce feedback.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

The technologies described herein can typically be utilized with transcutaneous bone conduction devices. Such devices utilize a vibration element to deliver stimuli in the form of vibrations to a skull of a recipient, through the intervening tissues (skin, muscle, fat). The intervening tissues dampen the vibrational stimuli, thus leading to transmission losses, which can have an adverse effect on device performance and user experience. In general, the technologies disclosed herein bias or pre-load the vibration element in the direction of the skin. Biasing elements such as coil springs, leaf springs, torsion springs, shape-memory elements, or elastomeric elements can be utilized, as described in more detail below. The biasing elements help ensure contact between the vibration element and the skin, thus helping ensure proper transmission of vibrational stimuli to the skull of the recipient. Depending on the biasing force, skin, muscle, and/or fat may be compressed so as to increase transmission of vibrations to the skull. In embodiments, the biasing force is sufficient to improve transmission, but insufficient to cause necrosis of the skin.

Additionally, since the biasing elements display resiliency, these elements help decouple or isolate the vibration element from sound processing components that can be disposed within a housing of a transcutaneous bone conduction device, such as the BTE devices depicted in FIGS. 1-4. Isolating the vibration elements from the sound processing components helps reduce or eliminate feedback that can be caused when the vibration element vibrates in close proximity to the sound processing components.

Figure 1:
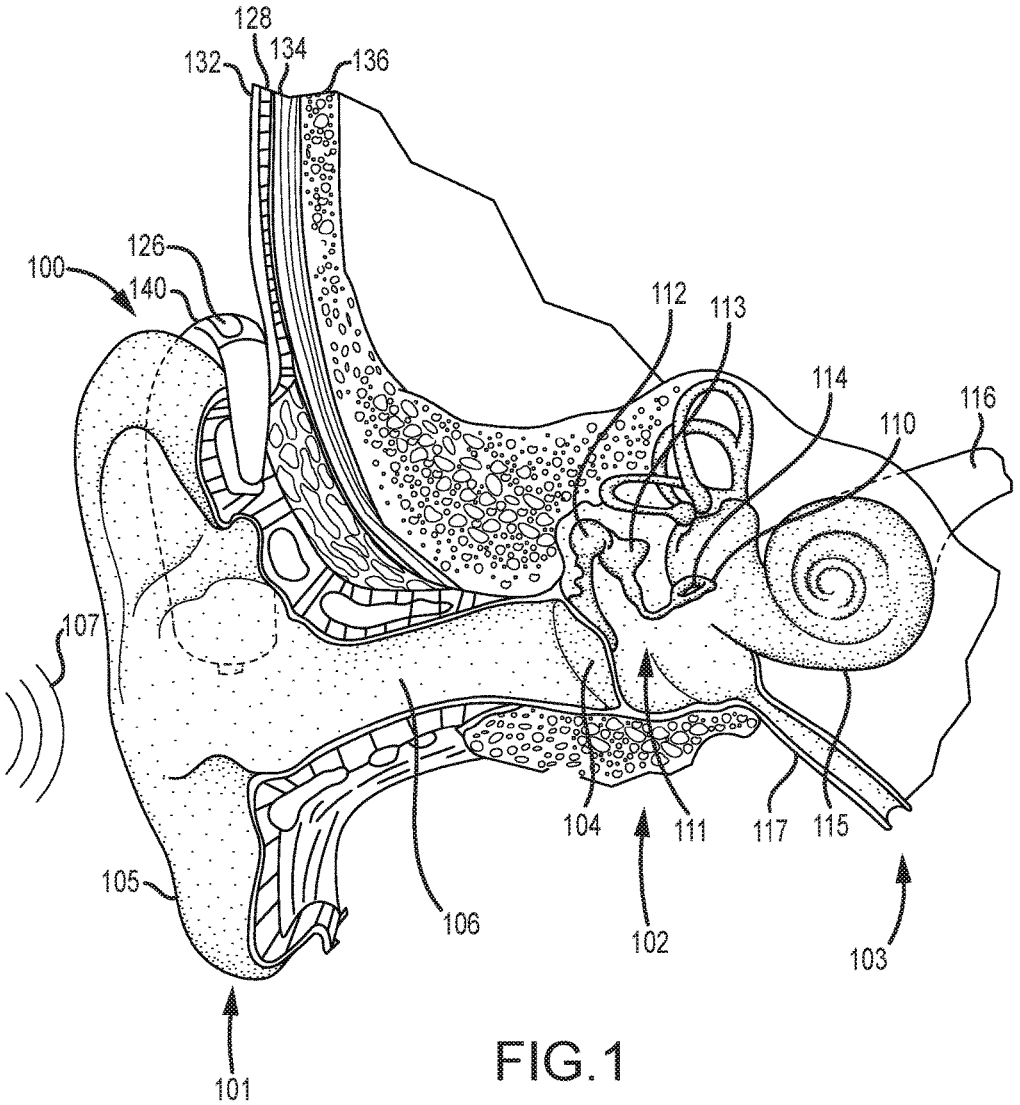
FIG. 1 is a view of a passive transcutaneous bone conduction device worn on a recipient.

A first type of transcutaneous bone conduction device 100 is depicted in FIG. 1, as worn by a recipient. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113, and the stapes 114. The ossicles 111 of middle ear 102 serve to filter and amplify acoustic wave 107, causing oval window 110 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of conduction device 100 relative to outer ear 101, middle ear 102 and inner ear 103 of a recipient of device 100. As shown, bone conduction device 100 is positioned behind outer ear 101 of the recipient. Bone conduction device 100 comprises an external component 140 in the form of a BTE device.

External component 140 typically comprises one or more sound input elements 126, such as a microphone, for detecting and capturing sound, a sound processing unit (not shown) and a power source (not shown). The microphone and sound processing unit can be referred to collectively as sound processing components. The external component 140 includes an actuator (not shown), which in the embodiment of FIG. 1, is located within the body of the BTE device, such embodiments are described further in relation to FIGS. 1A-4. In other embodiments, the actuator can be located remote from the BTE device (or other component of the external component 140 having a sound input element, a sound processing unit and/or a power source, etc.). Such embodiments are described further in relation to FIGS. 5-9.

It is noted that sound input element 126 can comprise, for example, devices other than a microphone, such as, for example, a telecoil, etc. In an exemplary embodiment, sound input element 126 can be located remote from the BTE device and can take the form of a microphone or the like located on a cable or can take the form of a tube extending from the BTE device, etc. Alternatively, sound input element 126 can be subcutaneously implanted in the recipient, or positioned in the recipient's ear. Sound input element 126 can also be a component that receives an electronic signal indicative of sound, such as, for example, from an external audio device. For example, sound input element 126 can receive a sound signal in the form of an electrical signal from an MP3 player electronically connected to sound input element 126.

The sound processing unit of the external component 140 processes the output of the sound input element 126, which is typically in the form of an electrical signal. The processing unit generates control signals that cause the actuator to vibrate. In other words, the actuator converts the electrical signals into mechanical vibrations for delivery to the recipient's skull.

As noted above, with respect to the embodiment of FIG. 1, bone conduction device 100 is a passive transcutaneous bone conduction device. That is, no active components, such as the actuator, are implanted beneath the recipient's skin 132. In such an arrangement, as will be described below, the active actuator is located in external component 140.

The embodiment of FIG. 1 is depicted as having no implantable component. That is, vibrations generated by the actuator are transferred from the actuator, into the skin directly from the actuator and/or through a housing of the BTE device, through the skin of the recipient, and into the bone of the recipient, thereby evoking a hearing percept without passing through an implantable component. In this regard, it is a totally external bone conduction device. Alternatively, in an exemplary embodiment, there is an implantable component that includes a plate or other applicable component, as will be discussed in FIG. 1A below. The plate or other component of the implantable component vibrates in response to vibration transmitted through the skin.

Figure 1A:
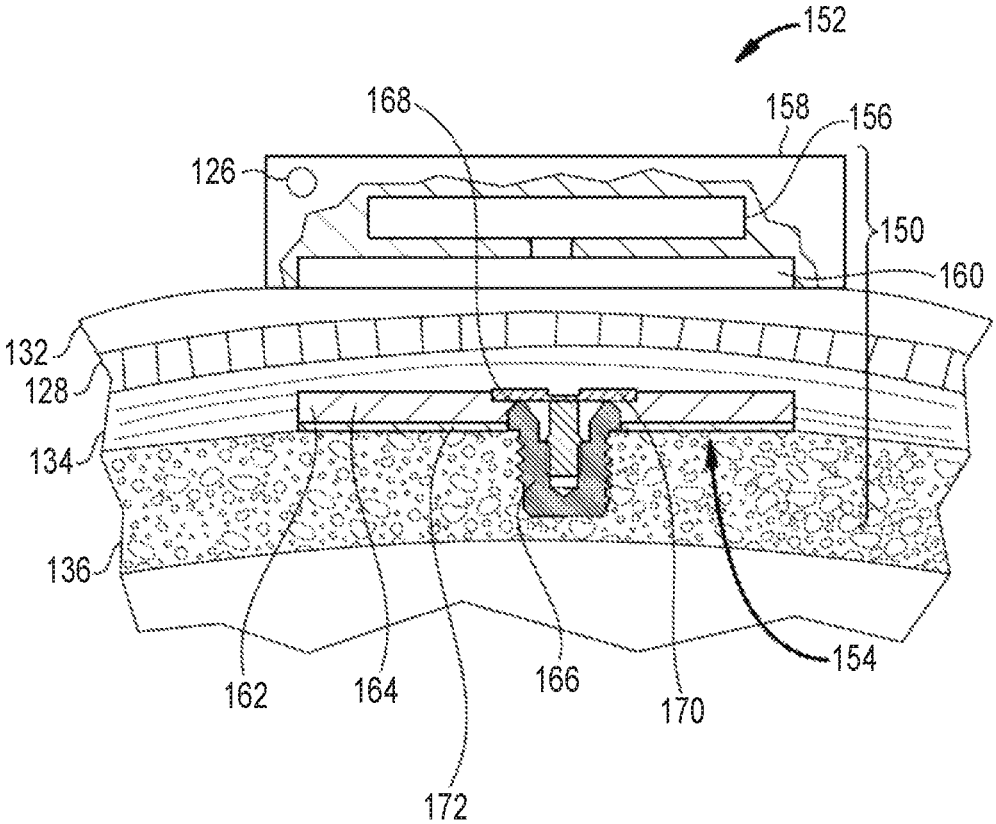
FIG. 1A is a cross-sectional schematic view of a passive transcutaneous bone conduction device worn on a recipient.

FIG. 1A depicts an exemplary embodiment of a transcutaneous bone conduction device 150 that includes an external device 152 and an implantable component 154. The transcutaneous bone conduction device 150 of FIG. 1A is a passive transcutaneous bone conduction device in that a vibrating actuator 156 is located in the external device 152. Vibrating actuator 156 is located in housing 158 of the external component, and is coupled to plate 160. Plate 160 can be in the form of a permanent magnet and/or in another form that generates and/or is reactive to a magnetic field, or otherwise permits the establishment of magnetic attraction between the external device 152 and the implantable component 154 sufficient to hold the external device 152 against the skin of the recipient.

In an exemplary embodiment, the vibrating actuator 156 is a device that converts electrical signals into vibration. In operation, sound input element 126 converts sound into electrical signals. Specifically, the transcutaneous bone conduction device 150 provides these electrical signals to vibrating actuator 156, or to a sound processor (not shown) that processes the electrical signals, and then provides those processed signals to vibrating actuator 156. The vibrating actuator 156 converts the electrical signals (processed or unprocessed) into vibrations. Because vibrating actuator 156 is mechanically coupled to plate 160, the vibrations are transferred from the vibrating actuator 156 to plate 160. Implanted plate assembly 162 is part of the implantable component 154, and is made of a ferromagnetic material that can be in the form of a permanent magnet, that generates and/or is reactive to a magnetic field, or otherwise permits the establishment of a magnetic attraction between the external device 152 and the implantable component 154 sufficient to hold the external device 152 against the skin of the recipient. Accordingly, vibrations produced by the vibrating actuator 156 of the external device 152 are transferred from plate 160 across the skin to plate 164 of plate assembly 162. This can be accomplished as a result of mechanical conduction of the vibrations through the skin, resulting from the external device 152 being in direct contact with the skin and/or from the magnetic field between the two plates. These vibrations are transferred without penetrating the skin 132, fat 128, or muscular 134 layers on the head.

As may be seen, the implanted plate assembly 162 is substantially rigidly attached to bone fixture 166 in this embodiment. Implantable plate assembly 162 includes through hole 168 that is contoured to the outer contours of the bone fixture 166. This through hole 168 thus forms a bone fixture interface section that is contoured to the exposed section of the bone fixture 166. In an exemplary embodiment, the sections are sized and dimensioned such that at least a slip fit or an interference fit exists with respect to the sections. Plate screw 170 is used to secure plate assembly 162 to bone fixture 166. As can be seen in FIG. 1A, the head of the plate screw 170 is larger than the hole through the implantable plate assembly 162, and thus the plate screw 170 positively retains the implantable plate assembly 162 to the bone fixture 166. A silicone layer 172 is located between the plate 164 and bone 136 of the skull.

Figure 2A:
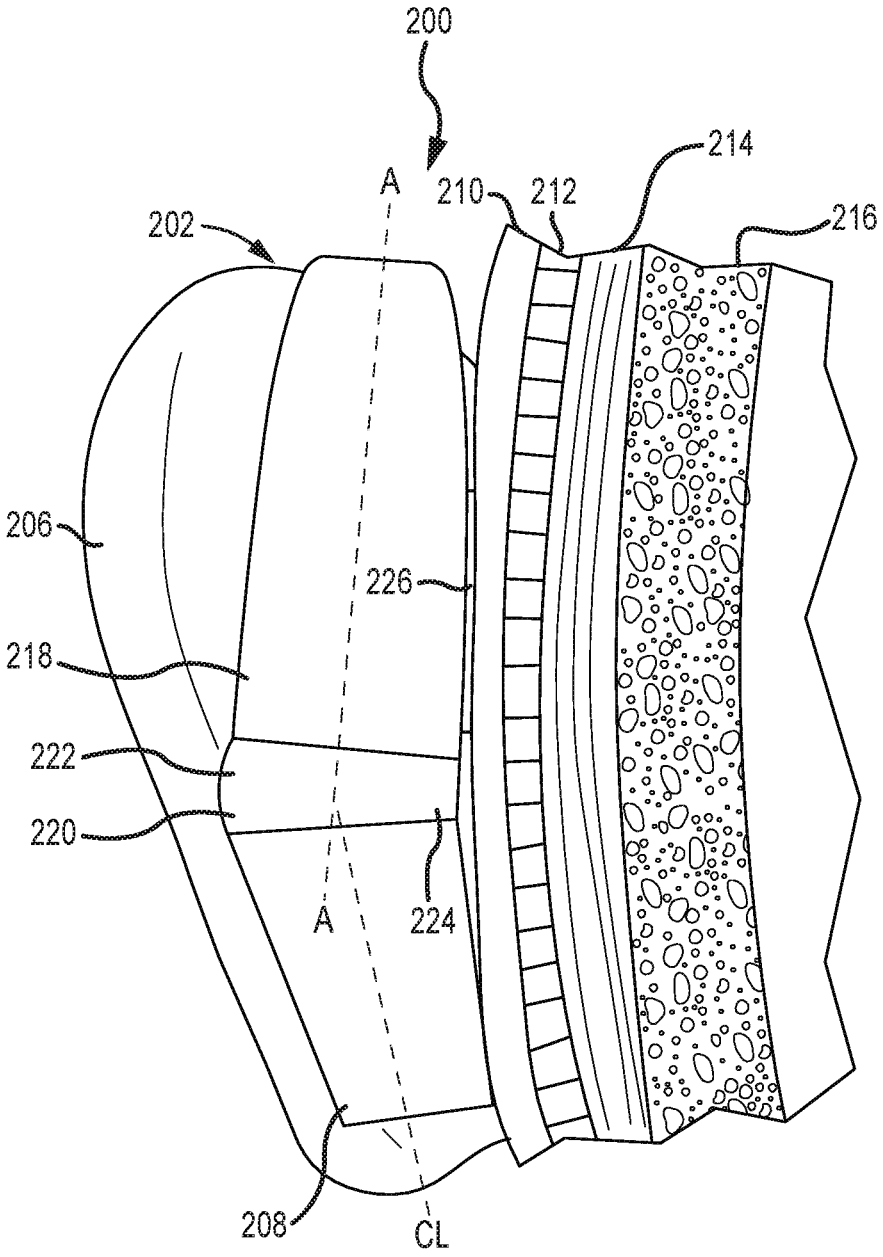
FIGS. 2A and 2B are rear views of another embodiment of a passive transcutaneous bone conduction device worn on a recipient.
Figure 2B:
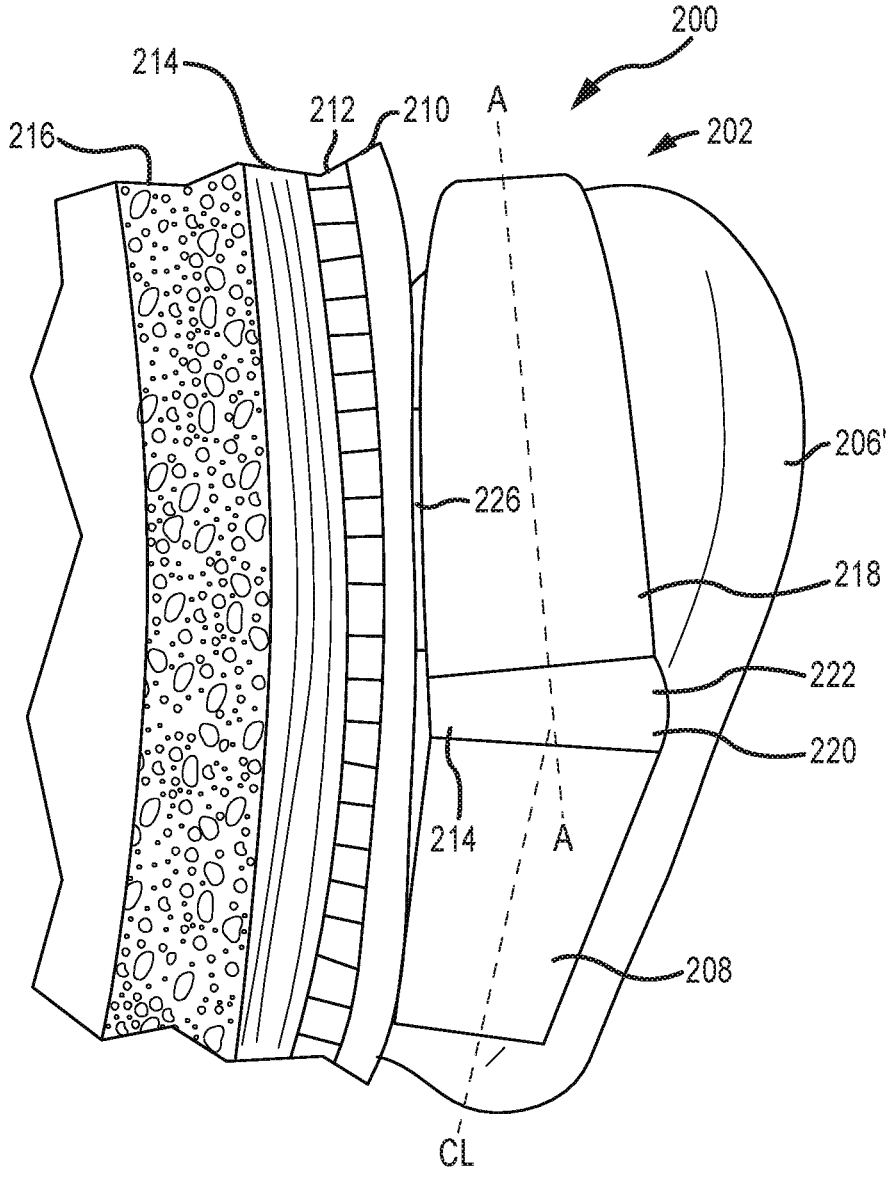

FIGS. 2A and 2B depict a BTE device 200 worn by a recipient 202. As described above, the BTE device 200 is worn behind a left ear 206 (in FIG. 2A) and includes a passive transcutaneous vibration element 208 that transmits vibrations through the skin 210, fat 212, and muscle 214 of the head to the skull 216. An implantable plate such as depicted in FIG. 1A is not depicted but can be utilized with the BTE device 200 as required or desired for a particular application. The vibration element 208 is secured to a BTE device housing 218 with a resilient connection element 220. The housing 218 defines an axis A, wherein the housing 218 is substantially symmetrical on either side of the axis A. This symmetry allows the same BTE device 200 to be worn behind a right ear 206', as depicted in FIG. 2B. The connection element 220 can be a shaped elastomeric material having a wide portion 222 and a narrow portion 224. The connection element 220 can be movable relative to the housing 218 (rotatable, releasable, or otherwise). Due to the symmetry of the of the housing 218, depending on the orientation of the connection element 220, the BTE device 200 can be configured so as to be worn behind either ear 206, 206'. Of course, the housing 218 need not be symmetrical. An adhesive 226 can be used to help ensure contact between the housing 28 and the skin 210. Alternatively or additionally, adhesive can be used to secure the vibration element 208 to the skin 210. The narrow portion 224 of the connection element is disposed so as to be located proximate to the skin 210 of the recipient 202.

Figure 3A:
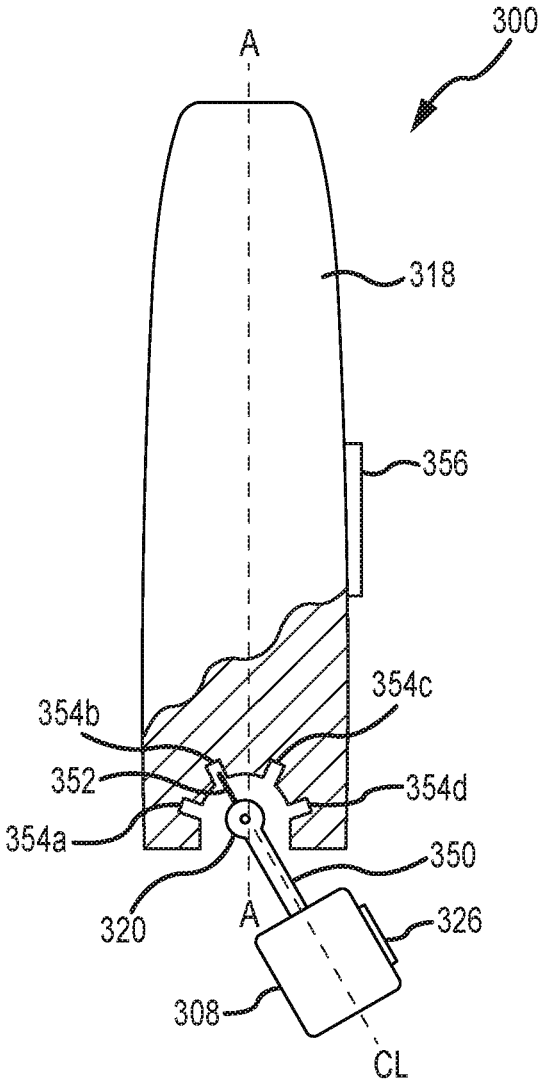
FIG. 3A is a rear view of an embodiment of a passive transcutaneous bone conduction device.
Figure 3B:
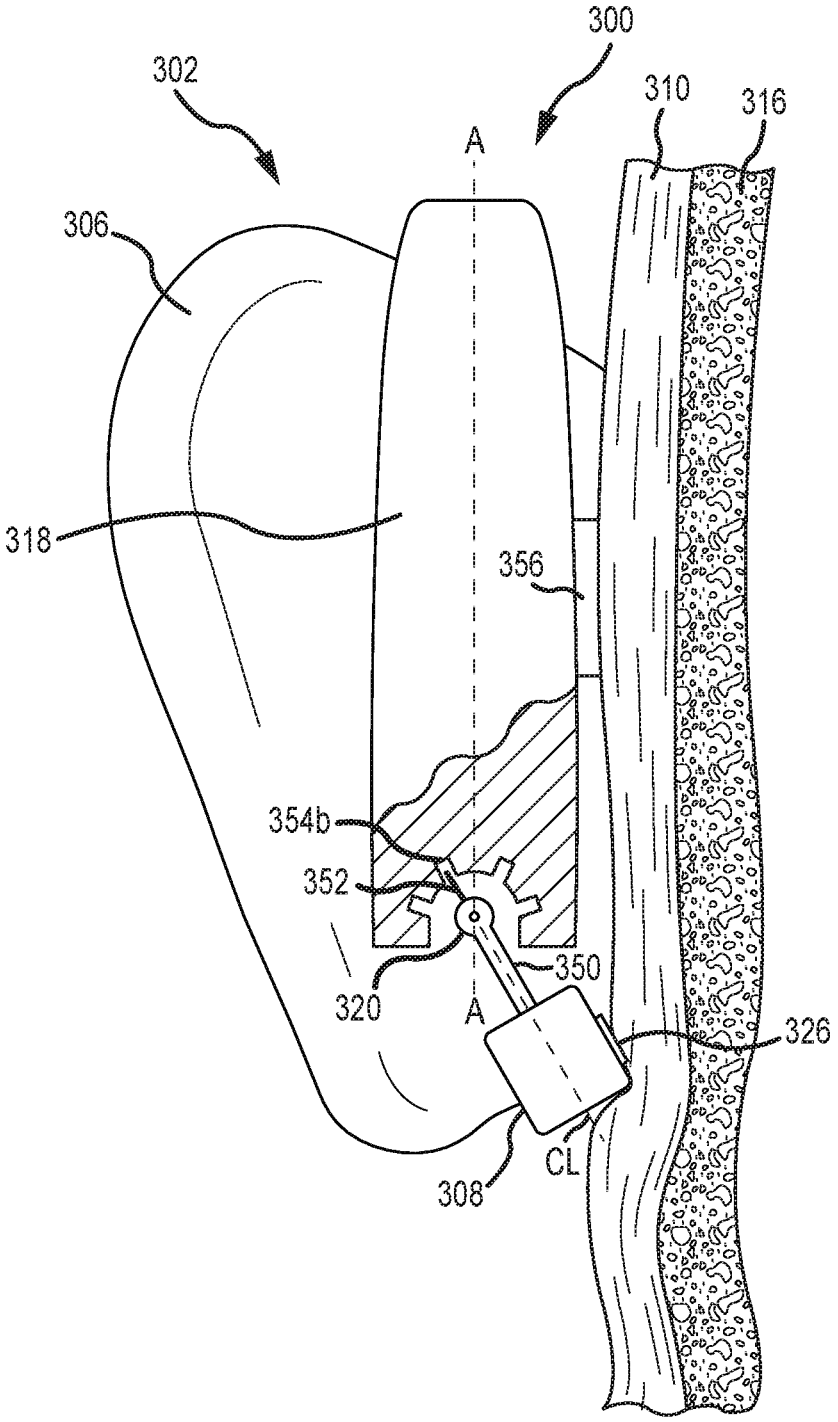
FIG. 3B is a rear view of the passive transcutaneous bone conduction device of FIG. 3A worn on a recipient.

FIGS. 3A and 3B depict another embodiment of a BTE device 300. The BTE device 300 includes a housing 318 and a vibration element 308 connected thereto via a connection element 320. As described above, an adhesive 326 can be secured to the vibration element 308. In this embodiment, the connection element 320 is a ratchet connection that includes an arm 350 connected at a first end to the vibration element 308. A second end of the arm 350 is pivotably connected to the housing 318. A pin or tooth 352 extends from the second end of the arm 350 and is configured to engage one of a plurality of detents 354 defined by the housing 318. As depicted in FIG. 3A, with the pin 352 disposed in the second detent 354, a centerline $C_L$ of the vibration element 308 is oriented at an angle to an axis A of the housing 318. When worn on an ear 306 of a recipient 302, the force applied by the pin 352 into the detent 354*b* helps keep the vibration element 308 in contact with the skin 310, thus ensuring proper transmission of the vibrations to the skull 316. The position of the pin 352 (in a particular detent 354) can be adjusted as required or desired for a particular application for comfort or force-application purposes. Additionally, detents 354*c*, 354*d* disposed on the opposite side of the axis A allow the vibration element to extend toward an opposite side of the axis A. This enables the BTE device 300 to be used on the opposite ear since it is symmetrical about axis A. An adhesive 356 can alternatively or additionally be utilized on the housing 318 so as to secure the housing to the skin 310.

Figure 4:
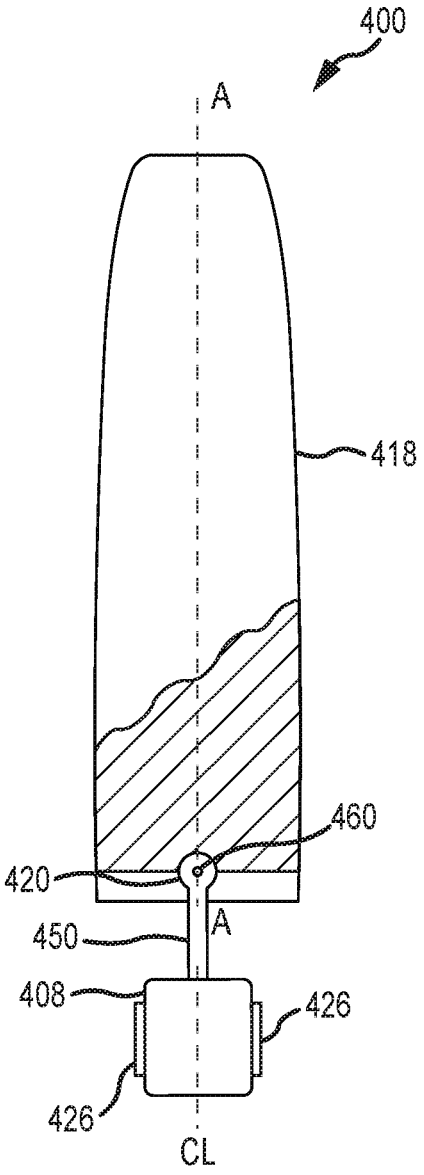
FIG. 4 is a rear view of another embodiment of a passive transcutaneous bone conduction device.

FIG. 4 depicts another embodiment of a BTE device 400, including a housing 418 and a vibration element 408 connected thereto with a connection element 420. In this case, the connection element 420 is an arm 450 movably secured to the housing 418 with a screw, bolt, or other adjustable or removable connecting fixture 460. Accordingly, although depicted with a centerline $C_L$ of the vibration element 408 aligned with the housing axis A, the connecting fixture 460 can be adjusted so as to bias the vibration element 408 to either side of the axis A. Adhesive elements 426 can be disposed on either both sides of the vibration element 408 to further secure the appropriate side to skin of a recipient.

The configurations of the connection elements described above orient or bias the vibration element of each device to one side of the axis A or housing. Due to this orientation or biasing, a centerline $C_L$ of the vibration element is not aligned with the axis A of the housing and is pressed against the skin. Angles between the axis A of the housing and the centerline $C_2$ of the vibration element can be about 5 degrees to about 85 degrees, from about 15 degrees to about 75 degrees, and from about 25 degrees to about 65 degrees. In certain embodiments, the angle can be about 45 degrees. It is contemplated that the arms 350, 450 depicted in FIGS. 3A-4 can be manufactured of one or more springs, shape memory elements, or elastomers. Although depicted as straight, these arms 350, 450 can be pre-shaped to further orient the vibration element towards one side of the axis A.

Figure 5:
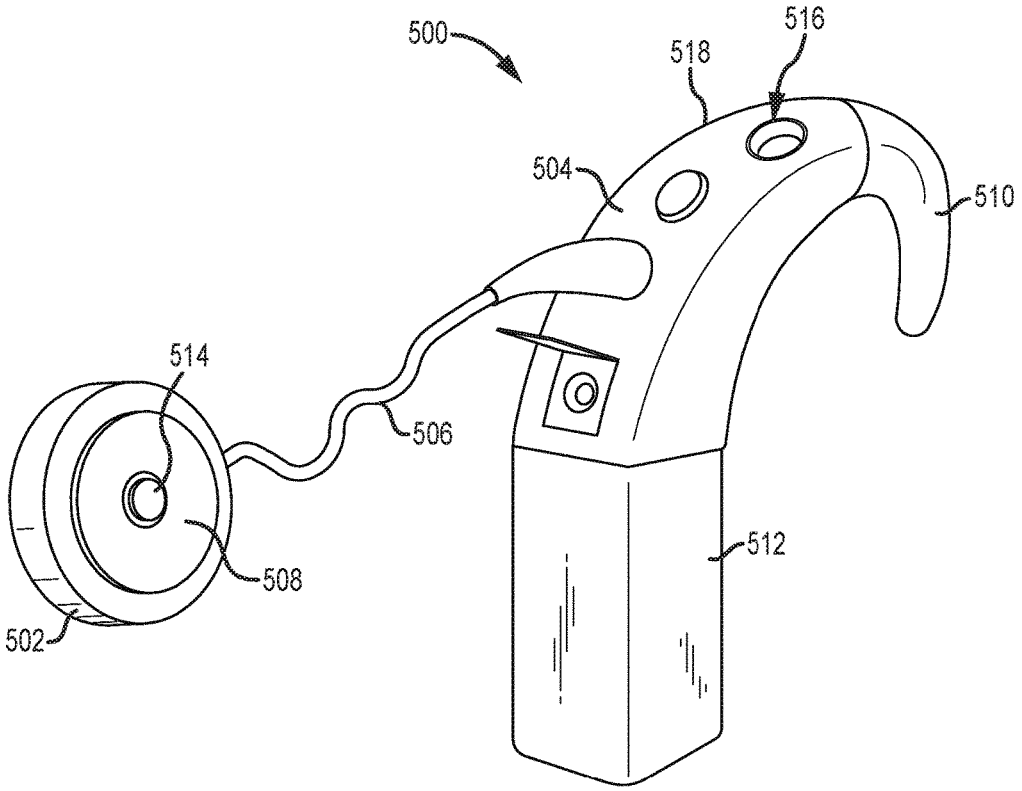
FIG. 5 is a perspective view of another embodiment of a passive transcutaneous bone conduction device.

FIG. 5 depicts an alternate embodiment of a passive transcutaneous bone conduction device 500, in which a vibrating element 514 is located in a remote vibrator actuator unit 502, as opposed to on the BTE device 504. Vibrator actuator unit 502 is in electronic communication with the BTE device 504 via a cable 506. In this regard, electrical signals are transferred to the vibration element 514 in the vibration actuator unit 502. Vibration actuator unit 502 can include a securing or fixation element 508 to removably attach the unit 502 to outer skin of the recipient. The securing or fixation element 508 can correspond to the elements detailed herein, for example, adhesives and/or magnets. The BTE device 502 also includes an earhook 510 for holding the device 502 about the ear of a recipient, and a battery compartment 512. Further, a housing 518 defines a microphone inlet 516 through which sound is received. The sound is processed by a sound processor and corresponding signals sent to the vibration element 518.

The configuration depicted in FIG. 5 further reduces feedback as compared to the configurations depicted in the preceding figures, where the vibration element is located in the BTE device itself. FIGS. 6-9 depict various embodiments of vibration actuation units, as originally depicted in FIG. 5. The technologies disclosed in FIGS. 6-9 can also be utilized in BTE devices such as those depicted herein. Devices utilizing a vibration actuation unit de-coupled or otherwise disconnected from the BTE device (which contains the microphone and sound processing components) display reductions in feedback. The vibrations output by the vibration element disposed within the vibration actuation unit dissipate along the cable, and feedback is reduced or eliminated. BTE devices in communication with discrete vibration actuation devices via wireless communications display similar advantages. In these embodiments, biasing elements such as coil springs, leaf springs, torsion springs, shape-memory elements, or elastomeric elements can be utilized to bias a vibration element toward the skin of a recipient. Regardless, in the following embodiments, the biasing elements are depicted and described as coil springs.

Figure 6:
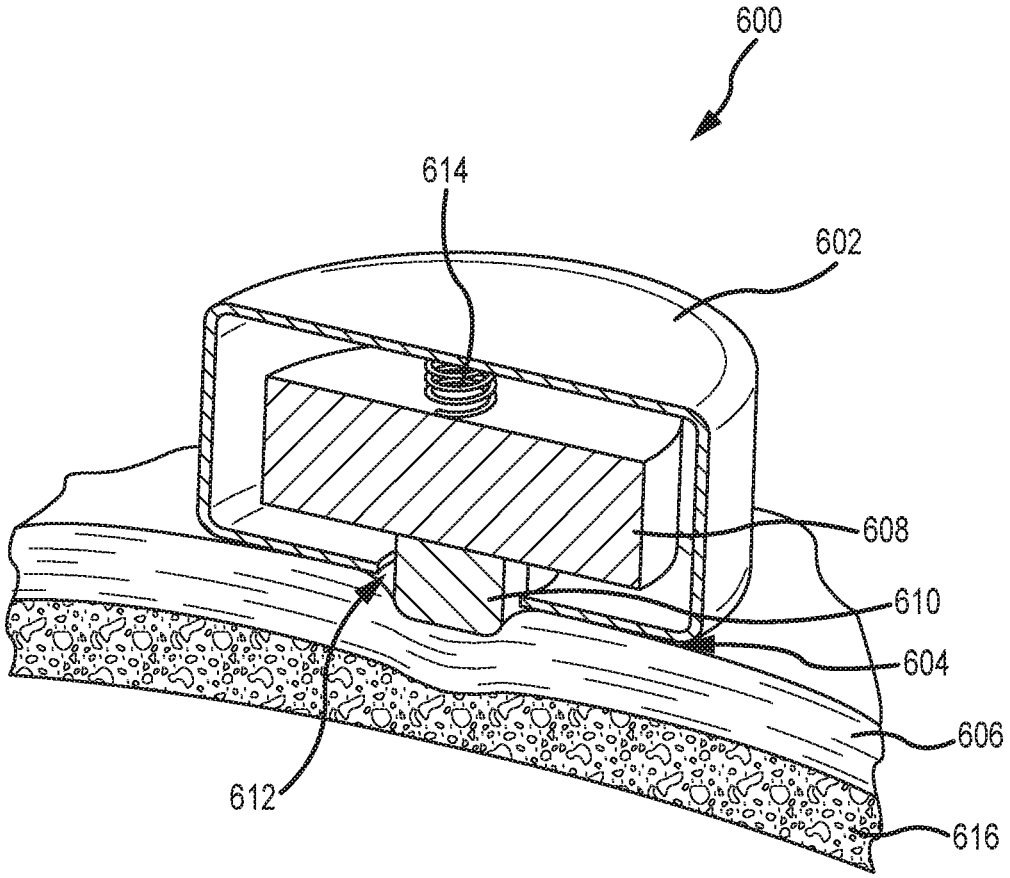
FIGS. 6 and 7 are perspective cross-sectional views of embodiments of remote vibrator actuator units.

FIG. 6 depicts an embodiment of a vibration actuation unit 600. The unit 600 includes a housing 602 that includes an outer surface 604. An adhesive, such as described above, can be used to adhere the outer surface 604 to the skin 606 of a recipient. Alternatively, a magnet located proximate the outer surface 604 can be utilized to magnetically couple the housing 602 to the skin 606, via an implanted magnetic coil, as described above. The outer surface can be shaped (e.g., concave) so as to comfortably more interface with the skin 606. A vibration element 608 is located inside the housing 602. In this embodiment, the vibration element 608 includes a projection 610 that extends through an opening 612 defined by the outer surface 604. Signals sent via the cable (described with regard to FIG. 5, above) cause vibrations of the vibration element 608. A coil spring 614 pushes the vibration element 608 towards the skin 606, thus helping to ensure good transmissions of the vibrations act more robustly on the skull 616.

Figure 7:
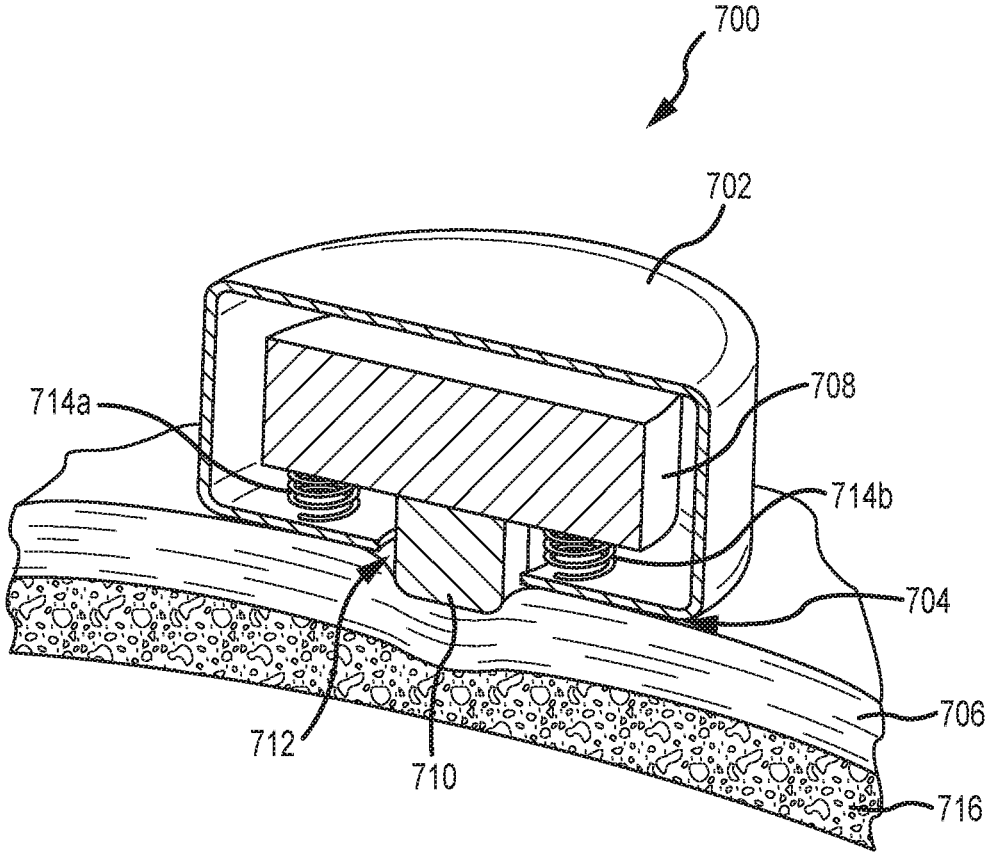

FIG. 7 depicts another embodiment of a vibration actuation unit 700. The unit 700 includes a housing 702 that includes an outer surface 704. An adhesive can be used to adhere the outer surface 704 to the skin 706. Alternatively, a magnet can be used. A vibration element 708 is located inside the housing 702 and includes a projection 710 that extends through an opening 712 defined by the outer surface 704. Signals sent via the cable cause vibrations of the vibration element 708. In this embodiment, two coil springs 714*a*, 714*b* pull the vibration element 708 towards the skin 706, thus helping to ensure that the vibrations transmit to the skull 716. More than two coil springs 714*a*, 714*b* can be utilized. It can be advantageous to position the springs so as to balance the force applied by the springs to the skin 706, thus ensuring even contact between the vibration element 708 (or its projection 710) and the skin 706.

Figure 8:
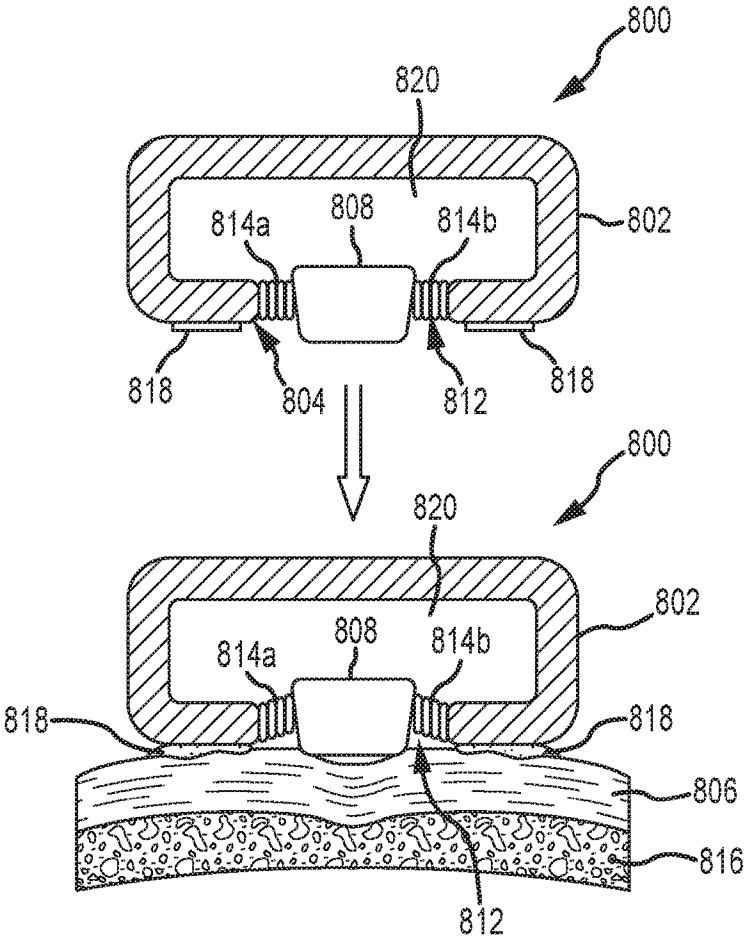

FIG. 8 depicts a cross-sectional view of another embodiment of a vibration actuation unit 800. Here, the unit 800 includes a housing 802 defining an opening 812 in an outer surface 804 thereof. An adhesive 818 is disposed on the outer surface 804, in this case, on either side of the opening 812. In alternative embodiments, the adhesive can surround or substantially surround the opening 812 or a magnet can be used. The arrangement of the adhesive is not critical to the embodiments disclosed herein, and need only be sufficient to fix the unit 800 to a skin surface 806 of a recipient. The opening 812 is spanned by a plurality of springs 814*a*, 814*b*, two of which are depicted in the figure. In other embodiments, three or more springs can also be used to provide a biasing force to a vibration element 808. As described above, any number of springs can be utilized and positioned so as to balance the force applied to the vibration element 808. When not secured to the skin 806 (as depicted in the upper portion of FIG. 8), the springs 814*a*, 814*b* hold the vibration element 808 across the opening 812. When secured to the skin 806 (as depicted in the lower portion of FIG. 8), the springs 814*a*, 814*b* deflect proportionally to the amount of force applied by the skin 806 to the vibration element 808. The force applied by the skin 806 to the vibration element 808 causes the vibration element 808 to deflect into an interior 820 of the housing 802, but the springs 814*a*, 814*b* continue to apply a force to the vibration element 808, thus urging it into contact with the skin 806, ensuring that vibrations are transmitted to the skull 816.

Figure 9:
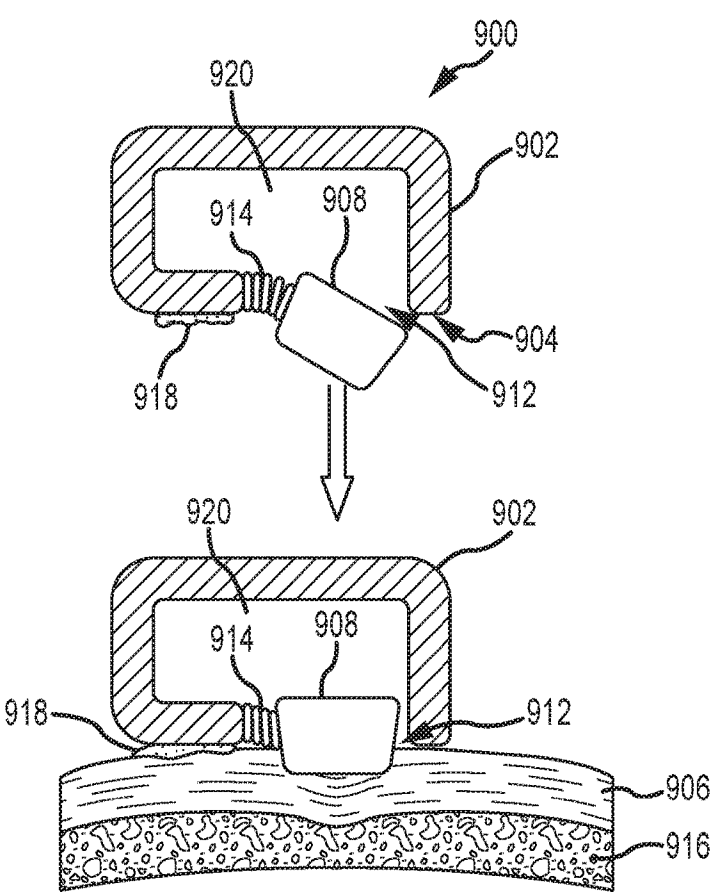
FIGS. 8 and 9 are cross-sectional views of other embodiments of remote vibrator actuator units.

FIG. 9 depicts a cross-sectional view of yet another embodiment of a vibration actuation unit 900. The unit 900 includes a housing 902 defining an opening 912 in an outer surface 904 thereof. An adhesive 918 is disposed on the outer surface 904. A spring 914 projects into the opening 912 and supports a vibration element 908. The weight of the vibration element 908 and/or shape of the spring 914 causes the vibration element to project below an outer surface 904 of the housing 902 when not secured to the skin 906 (as depicted in the upper portion of FIG. 9). When secured to the skin 906 (as depicted in the lower portion of FIG. 9), the spring 914 deflects proportionally to the amount of force applied by the skin 906 to the vibration element 908. The force applied by the skin 906 to the vibration element 908 causes the vibration element 908 to deflect into the interior 920 of the housing 902, but the spring 914 continues to apply a force to the vibration element 908, thus urging it into contact with the skin 906, ensuring that vibrations are transmitted to the skull 916. In addition to the embodiments of vibration actuation units depicted above, other configurations, with other biasing elements vibration element shapes and sizes, etc., are contemplated. For examples, both tension and extension biasing elements can be utilized, as can multiple vibration elements.

The adhesives described herein are depicted in an exaggerated manner so as to be more easily identified. In certain embodiments, the adhesives are double sided tape, where one side of the tape is protected by a barrier, such as a silicone paper, that is removed from the skin-side of the double-sided tape in relatively close temporal proximity to the placement of the device on the recipient. In other embodiments, adhesives are glue or the like. The glue can be applied in relatively close temporal proximity to the placement of the device on the recipient. Such application can be applied by the recipient to the BTE device, vibration element and or vibration actuation unit.

In another embodiment, the adhesives are of a configuration where the adhesive has relatively minimal adhesive properties during a temporal period when exposed to some conditions, and has relatively effective adhesive properties during a temporal period, such as a latter temporal period, when exposed to other conditions. Such a configuration can provide the recipient control over the adhesive properties of the adhesives.

By way of example, the glue and/or tape (double-sided or otherwise) can be a substance that obtains relatively effective adhesive properties when exposed to oil(s) and/or sweat produced by skin, when exposed to a certain amount of pressure, when exposed to body heat, etc., and/or a combination thereof. In another embodiment, heat generated via friction resulting from the recipient rubbing his or her finger across the glue can activate the adhesive properties thereof. In another embodiment, the pressure can be a pressure above that which can be expected to be experienced during normal handling of the device.

In another embodiment, the adhesives are contained in a container that dispenses glue or the like when exposed to certain conditions. Alternatively and/or additionally, the recipient can puncture or otherwise open the containers to exude the glue or the like. In certain embodiments, the adhesive 90 degree retention force can be selected to be between about 2 N and about 10 N.

This disclosure described some embodiments of the present technology with reference to the accompanying drawings, in which only some of the possible embodiments were shown. Other aspects, however, can be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. An apparatus comprising:

a first housing having a first end comprising an earhook and a second end;

a sound processing component disposed in the first housing;

a resilient connection element connected to the second end of the first housing; and a second housing discrete from the first housing and connected to the resilient connection element, wherein the resilient connection element reduces feedback to the sound processing component from a vibration generated in the second housing.

2. The apparatus of claim 1, further comprising a microphone in the first housing disposed proximate the earhook and communicatively coupled to the sound processing component.

3. The apparatus of claim 1, further comprising a vibration element for generating the vibration.

4. The apparatus of claim 1, wherein the first housing is unaligned with the second housing.

5. The apparatus of claim 4, wherein the resilient connection element comprises a shaped configuration so as to maintain the unalignment of the first housing and the second housing.

6. The apparatus of claim 5, wherein the shaped configuration comprises a wide portion and a narrow portion.

7. The apparatus of claim 1, wherein the apparatus is configured to be supported from a recipient only by the earhook.

8. A transcutaneous bone conduction device comprising:

a first body for supporting the transcutaneous bone conduction device on an ear of a recipient and comprising a sound input device;

a second body comprising a vibration output device to deliver a vibration to the recipient; and a connection element connecting the first body to the second body and for reducing a vibration transmitted from the second body to the first body.

9. The transcutaneous bone conduction device of claim 8, wherein the connection element comprises a resilient material.

10. The transcutaneous bone conduction device of claim 9, wherein the connection element is connected to the an end of the first body and an end of the second body.

11. The transcutaneous bone conduction device of claim 8, further comprising a vibration output element disposed in the second body.

12. The transcutaneous bone conduction device of claim 8, wherein a centerline of the second body is disposed at an angle to an axis of the first body.

13. An apparatus comprising:

a sound processor housing comprising an earhook and a sound processor housing axis;

a sound processor disposed in the sound processor housing;

a transcutaneous vibration element housing comprising a transcutaneous vibration element housing centerline disposed at an angle to the sound processor housing axis;

a transcutaneous vibration element disposed in the transcutaneous vibration element housing; and a resilient connection element coupling the sound processor housing to the transcutaneous vibration element housing.

14. The apparatus of claim 13, wherein the resilient connection element comprises a narrow portion and a wide portion.

15. The apparatus of claim 14, wherein the narrow portion is disposed on a first side of the transcutaneous vibration element housing centerline and the wide portion is disposed on a second side of the transcutaneous vibration element housing centerline.

16. The apparatus of claim 13, wherein the resilient connection element comprises an elastomeric element.

17. The apparatus of claim 13, wherein the resilient connection element biases the transcutaneous vibration element housing towards a first side of the sound processor housing axis.

18. The apparatus of claim 13, wherein the resilient connection element is pre-shaped to bias the transcutaneous vibration element housing towards a first side of the sound processor housing axis.

19. The apparatus of claim 13, wherein the resilient connection element decouples a vibration generated by the transcutaneous vibration element from the sound processor.

* * * * *